United States Patent [19]

Tanca

[11] 4,445,441

[45] May 1, 1984

[54] SLAG TAP GAS FLOW INDUCEMENT IN WET-BOTTOM FURNACES

[75] Inventor: Michael C. Tanca, Tariffville, Conn.

[73] Assignee: Combustion Engineering, Inc., Windsor, Conn.

[21] Appl. No.: 500,118

[22] Filed: Jun. 1, 1983

[51] Int. Cl.[3] ..... F23J 1/00

[52] U.S. Cl. ..... 110/165 R; 110/171

[58] Field of Search ..... 110/165 R, 171, 259; 126/242

[56] References Cited

U.S. PATENT DOCUMENTS

| | | | |
|---|---|---|---|
| 1,957,583 | 5/1934 | Foresman | 110/165 R |
| 4,227,469 | 10/1980 | Collura | 110/171 |
| 4,301,747 | 11/1981 | Lockwood et al. | 110/171 |
| 4,321,877 | 3/1982 | Schmidt et al. | 110/165 R X |

*Primary Examiner*—Edward G. Favors

*Attorney, Agent, or Firm*—Arthur L. Wade

[57] ABSTRACT

A wet-bottom, solid fuel gasifier has a slag tap through which a portion of the product gas is back-flowed through the slag tap to maintain the temperature of the slag hot enough to maintain continuous slagging. The reverse flow of the product gas portion is controlled by the negative pressure generated in the throat of the gasifier.

2 Claims, 1 Drawing Figure

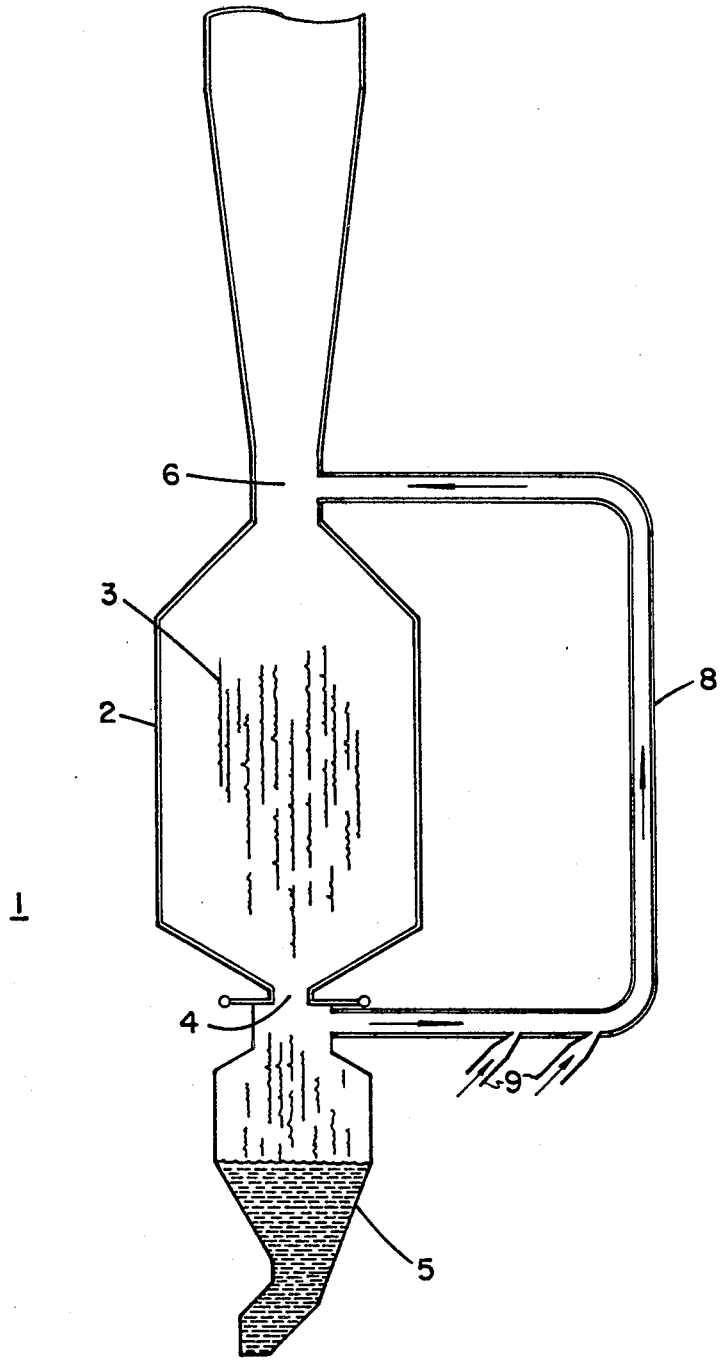
6
3
2
8
1
4
9
5

SLAG TAP GAS FLOW INDUCEMENT IN WET-BOTTOM FURNACES

TECHNICAL FIELD

The present invention is related to the removal of molten ash or slag through the lower tap of a wet-bottom furnace. More particularly, the invention is related to controlling the temperature of slag as it is drawn from the lower, bottom tap of a wet-bottom furnace to maintain the slag in a fluid-like state to discharge from the furnace without creating an obstruction.

BACKGROUND ART

Coal gasification units offer a viable alternative to flue gas scrubbing for the utilization of high sulfur coals in a commercial utility steam generator. Coal gasifiers, in conjunction with combined cycle power generation, offer a significant decrease in the plant heat rate, resulting in cost savings in the production of electricity. One of the most attractive coal gasifier designs is an entrained, upward gas flow unit firing pulverized coal to produce a low BTU and medium BTU product gas.

A benefit of the reaction of pulverized coal and air, substoichiometrically, at high temperatures (2500 F.–3500 F.) is that all ash contained in the coal is melted, that is liquified, so as to be removable by flowing under the influence of gravity to some type of ash-handling system. The melted ash (slag) gravitates down the walls and the sloped floor of the reactor to some opening, commonly called a slag tap, which provides an outlet for slag flowing from the reactor so it can be deposited in the slag-handling system below the furnace.

Throughout the history of entrained flow reactors with vertical gas outlets, problems have arisen with the lower portions of the reactor being cooler than the upper regions of the reactor due to localized heat transfer, vapors rising from the quench tank, and low stoichiometry due to poor mixing. A result is that slag flow is obstructed due to the temperature effect on slag viscosity and the slag becomes difficult to tap. Buildup of solidifying slag around the tap hole area, with the possibility of a slag hole pluggage, can make long-term operation difficult.

In order to alleviate the buildup condition, three major slagging aids in the present art are: first, the use of fluxing agents to decrease the slag viscosity; second, the use of ignitors at the tap hole region to add supplemental heat to the tap region; and third, the use of hot reverse gas from the combustor through the slag hole to some point downstream of the reactor. Not all coals can be mixed with fluxing agents to decrease the slag viscosity and fluxing agents can result in operational problems downstream of the reactor. The use of oil and gas ignitors at the slag tap to add supplemental heat requires the constant use of oil and natural gas, is not always effective, and is also expensive. Part of the hot gases has been reversed to flow through the slag tap and normally vented downstream of the reactor where they cannot be efficiently utilized. Reverse gas can be done utilizing a recirculating fan which vents the gases back to the reactor, but this requires cooling of the reverse gas from 2500 F. to 600 F. to protect the fan and the use of an inefficient fan. Both result in a large energy penalty.

Some arrangement is needed to keep the slag hot with the back-flow product gas from the reactor without incurring the penalties of using an induced draft fan for this purpose.

DISCLOSURE OF THE INVENTION

The present invention contemplates utilizing the reduced pressure area at the venturi throat of a gasifier reactor as the force with which to draw hot product gas through the slag tap and thereby maintain the temperature of the slag high enough to prevent solidification with consequent impediment or obstruction to the flow of slag.

The invention further contemplates a conduit connecting the area of reduced pressure in the throat of a gasifier reactor with the exit of the slag tap to develop a pressure sufficiently low within the slag tap to cause flow of a predetermined amount of product gas through the slag tap to maintain the temperature of the slag high enough for continuous slagging.

Other objects, advantages and features of this invention will become apparent to one skilled in the art upon consideration of the written specification, appended claims, and attached drawing.

BRIEF DESIGNATION OF THE DRAWING

The drawing is a somewhat schematic elevation of a gasifier reactor with a connection between its venturi throat and the slag tap exit embodying the present invention.

BEST MODE FOR CARRYING OUT THE INVENTION

Fuel, oxidant, and other reactants are fed substoichiometrically to a reactor vessel 1 where a desired product gas is produced. The reactor shell 2 is fabricated from a water-cooled steel tubing, water jacket construction, or a steel shell with a refractory lining, or a combination of all the above. The product gases 3, which typically range from 2500 F. to 3500 F., are sufficient to melt all ash components in the fuel to produce a running slag. The slag is tapped in the floor section of the reactor through a small refractory lined or water cooled slag tap 4 and flows by gravity to a water quench tank 5 where the slag is solidified, stored, and eventually transported for disposal elsewhere.

Product gases 3 leaving reactor 1 flow at high velocities (about 200 to 300 feet per second) up through a throat area 6 at the reactor outlet. Throat 6 is refractory lined to protect the shell from erosion. The high velocity gas through throat 6 creates a localized low or negative static pressure area. It is the object of the present invention to utilize the low pressure area at throat 6 to control the slagging through tap 4. This low pressure area will be utilized to force a portion of the product gases in the reactor to back-flow through slagging tap 4 so that their heat will ensure continuous slagging. Specifically, a duct or conduit 8 is connected from the low pressure area at throat 6 at its first end, and to the outlet duct of slag tap 4 at its second end. Thus, the low pressure is applied to the slag outlet and thereby causes a portion of the product gases to back-flow through the slag tap and maintain the temperature elevation of the slag which will prevent its solidification in the slag tap throat.

Back flow of the product gases through the slag tap will entrain a certain amount of particulate matter from the products of combustion. These particulates will be carried through duct 8 and consequently injected into throat 6. If there is danger of these particulates accumulating in the duct at any point, one or more duct sootblowers 9 can be strategically located to supply gas to keep the particulates entrained and thereby prevent the duct being clogged.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawing is to be interpreted in an illustrative and not in a limiting sense.

I claim:

1. In a furnace space wherein combustion is sustained and from which the products of combustion primarily discharge upwardly through a throat with a high velocity which generates a low value of local pressure and from which a slag tap throat extends downward for draining molten slag from the furnace space, a conduit connected at its first end with the low value local pressure area of the furnace throat and at its second end to the slag tap throat at a point below the entrance to the tap throat from the furnace space, whereby the low pressure of the furnace throat causes a portion of the combustion products of high temperature to flow downwardly through the tap throat in contact with the slag draining through the tap throat to maintain the temperature of the slag high enough to preclude solidification which would impede flow of the slag from the furnace space.

2. The conduit of claim 1, including, a source of gas connected to an intermediate section of the conduit to introduce the gas as a blowing medium to entrain particulates within the conduit and obviate their accumulation within the conduit.

* * * * *